US010925441B2

(12) United States Patent
Schuster

(10) Patent No.: US 10,925,441 B2
(45) Date of Patent: Feb. 23, 2021

(54) UNIVERSAL SINK STOPPER AND STRAINER

(71) Applicant: Danco, Inc., Irving, TX (US)

(72) Inventor: Michael J. Schuster, Shorewood, IL (US)

(73) Assignee: Danco, Inc., Irving, TX (US)

( * ) Notice: Subject to any disclaimer, the term of this patent is extended or adjusted under 35 U.S.C. 154(b) by 0 days.

(21) Appl. No.: 16/872,437

(22) Filed: May 12, 2020

(65) Prior Publication Data

US 2020/0268214 A1 Aug. 27, 2020

Related U.S. Application Data

(63) Continuation of application No. 15/973,260, filed on May 7, 2018, now Pat. No. 10,722,079.

(60) Provisional application No. 62/503,183, filed on May 8, 2017.

(51) Int. Cl.

| | |
|---|---|
| ***A47K 1/14*** | (2006.01) |
| ***E03C 1/23*** | (2006.01) |
| ***E03C 1/26*** | (2006.01) |

(52) U.S. Cl.

CPC ..... *A47K 1/14* (2013.01); *E03C 1/2302* (2013.01); *E03C 1/2306* (2013.01); *E03C 1/26* (2013.01); *E03C 2001/2315* (2013.01)

(58) Field of Classification Search

CPC ..... A47K 1/14; E03C 1/2302; E03C 1/2306

See application file for complete search history.

(56) References Cited

U.S. PATENT DOCUMENTS

| | | | |
|---|---|---|---|
| 5,271,108 | A | 12/1993 | Wicke |
| 2013/0191982 | A1 | 8/2013 | Booker |
| 2018/0320346 | A1 | 11/2018 | Jackson et al. |

OTHER PUBLICATIONS

U.S. Appl. No. 15/973,260, filed May 7, 2018, Restriction/Election dated Jul. 15, 2019.

U.S. Appl. No. 15/973,260, filed May 7, 2018, Non-Final Office Action dated Dec. 5, 2019.

U.S. Appl. No. 15/973,260, filed May 7, 2018, Notice of Allowance dated Mar. 10, 2020.

*Primary Examiner* — Christine J Skubinna

(74) *Attorney, Agent, or Firm* — Thomas Horstemeyer, LLP

(57) ABSTRACT

Disclosed are various embodiments for a universal sink stopper and strainer. Various embodiments can include a handle, a plate, and a gasket. The gasket can include a first plurality of holes. The plate can include a protrusion and a second plurality of holes. The protrusion is shaped to extend through a portion of the gasket. The handle is configured to rotate to adjust an alignment of the first plurality of holes of the gasket with respect to the second plurality of holes of the plate.

20 Claims, 18 Drawing Sheets

UNIVERSAL SINK STOPPER AND STRAINER

CROSS-REFERENCE TO RELATED APPLICATIONS

This continuation application claims priority to and the benefit of U.S. Non-provisional patent application Ser. No. 15/973,260, entitled "UNIVERSAL SINK STOPPER AND STRAINER" and filed on May 7, 2018, which claims priority to, and the benefit of, U.S. Provisional Patent Application No. 62/503,183, entitled "UNIVERSAL SINK STOPPER AND STRAINER" and filed on May 8, 2017, which are incorporated by reference as if set forth herein in their entireties.

BACKGROUND

Sinks are manufactured in many different sizes, shapes, and configurations. Accordingly, these sinks often have drain openings that can vary in width, depth, or shape from one sink to the next.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

In the following discussion, a general description of the system and its components is provided, followed by a discussion of the operation of the same.

Figure 1:
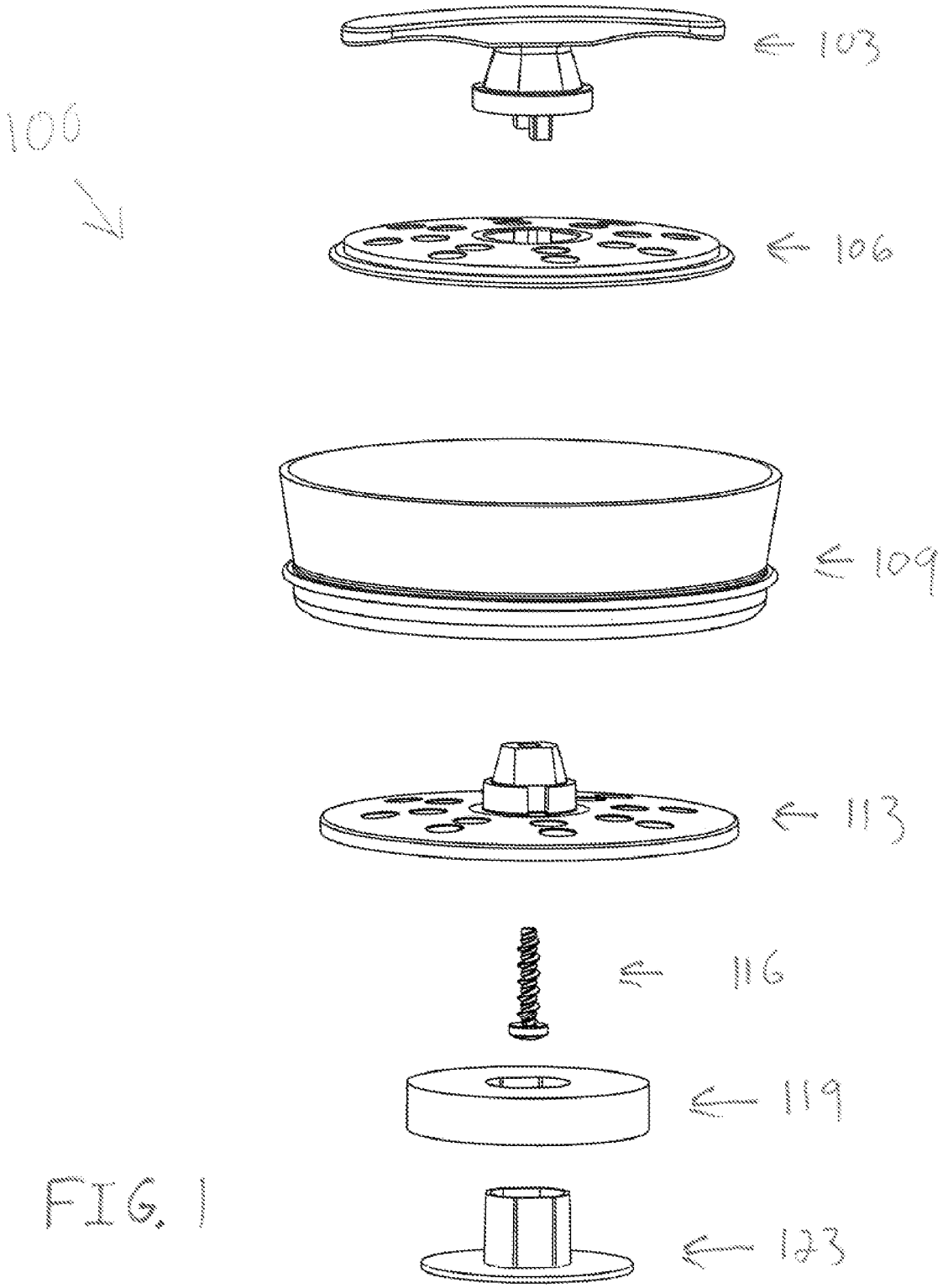
FIG. 1 is an exploded view of an example embodiment of the present disclosure.

FIG. 1 illustrates an exploded view of a sink stopper and strainer 100 according to an embodiment of the present disclosure. A handle 103, a first plate 106, a gasket 109, a second plate 113, a fastener 116, a biocide 119, and a container 123. Although specific implementations of the handle 103, first plate 106, gasket 109, second plate 113, fastener 116, biocide 119, and container 123 are depicted in FIG. 1, alternative implementations may be used in various embodiments of the present disclosure.

Figure 2A:
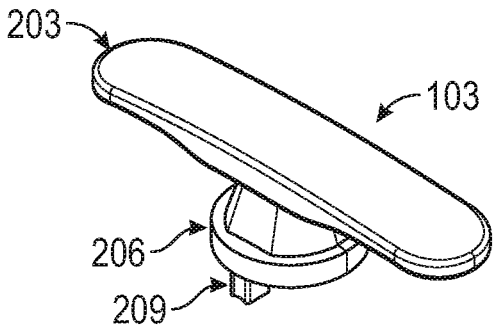
FIGS. 2A-2D depict a handle used in the embodiment illustrated in FIG. 1, according to various embodiments of the present disclosure.
Figure 2B:
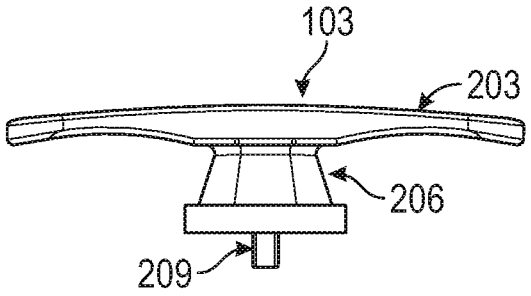
Figure 2C:
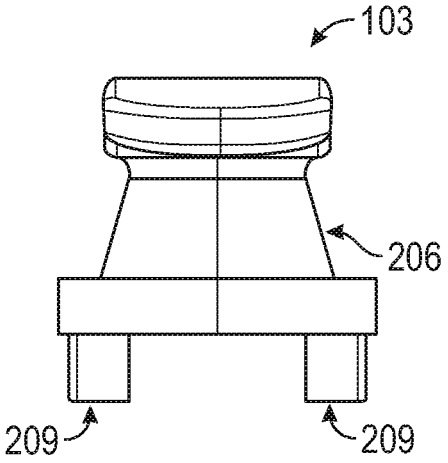

FIGS. 2A-2D depict a handle 103 according to various embodiments of the present disclosure. In FIG. 2A, a perspective view of the handle 103 is depicted. The handle 103 includes a grip 203, a base 206, and at least one prong 209 extending from the base 206. In some embodiments, the sides of the base 206 may taper as the sides extend from the junction of the base with the prong 209 to the junction of the base 206 with the grip 203. FIG. 2B depicts a side view of the handle 103 with the grip 203, base 206, and at least one prong 209 extending from the base 206. FIG. 2C depicts another side view of the handle 103. As shown, two prongs 209 on opposite sides of the base 206 protrude from the base 206. Although FIGS. 2A-2C depict a single prong 209 or two prongs 209, any number of prongs 209 may be protrude from the base, as appropriate.

Figure 2D:
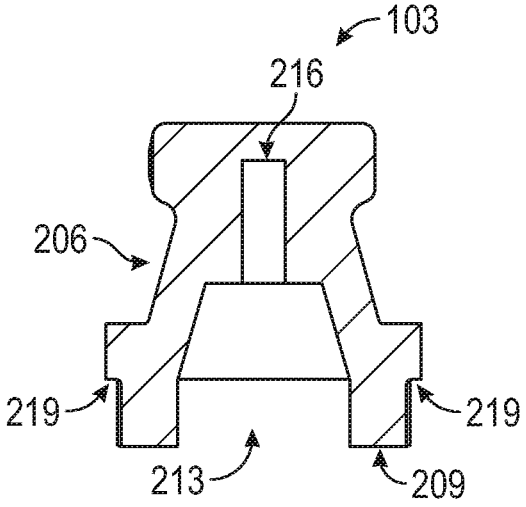

FIG. 2D depicts a cross section of the handle 103. As shown, within the base 206 is a primary internal cavity 213. Above the primary internal cavity 213 is a secondary cavity 216, which may be configured to receive a fastener 116 (FIG. 1), as further described herein. For example, the secondary cavity 216 may be threaded in order to receive a screw. In some embodiments, the external surface of prongs 209 may be offset relative to the external surface of the base 206, resulting in a ledge 219 to overhand the prongs 209.

Figure 3A:
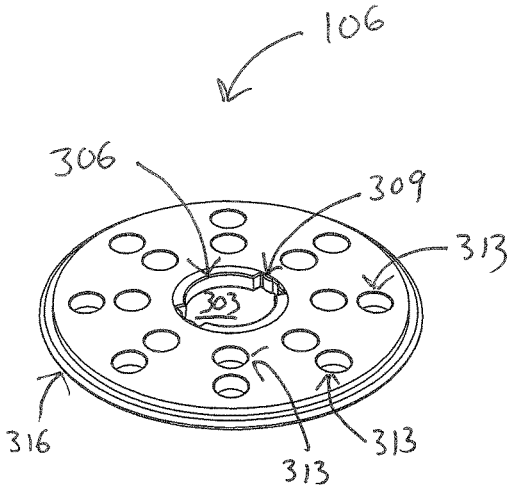
FIGS. 3A-3D depict a first plate used in the embodiment illustrated in FIG. 1, according to various embodiments of the present disclosure.
Figure 3B:
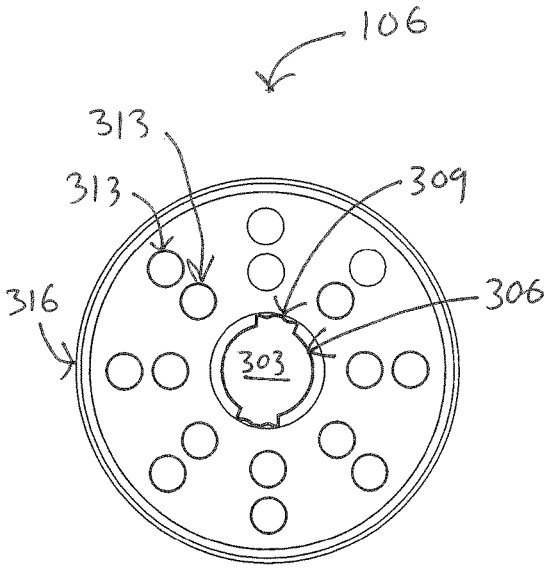
Figure 3C:
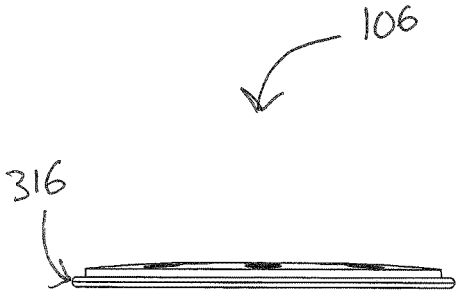

FIGS. 3A-3D depict an optional first plate 106 according to various embodiments of the present disclosure. In FIG. 3A, a perspective view of the first plate 106 is depicted. The first plate 106 includes a first hole 303 centered within the first plate 106. The first hole 303 includes an inner edge 306 and an outer edge 309. The first plate 106 can also include one or more second holes 313 positioned between the rim of the first plate 106 and the first hole 303. The first plate 106 can also include a lip 316 along the circumference of the first plate 106. A first surface of the lip 316 may lie on the same plane as a first surface of the first plate 106, while a second surface of the lip 316 may lie on a separate plane relative to a second surface of the first plate 106, causing the lip 316 to be thinner than the remaining portion of the first plate 106. For example, the bottom of the lip 316 may lie on the same plane as the bottom of the first plate 106, while the top of the lip 316 may lie on a lower plane than the top of the remaining portion of the first plate 106, resulting in a lip 316 that is thinner than the remaining portion of the first plate 106. FIG. 3B provides a top-down perspective of the first plate 106, showing the relative positions of the first hole 303, the inner edge 306 of the first hole 303, the outer edge 309 of the first hole 303, multiple second holes 313, and the lip 316, according to various embodiments of the present disclosure. FIG. 3C depicts a side view of the first plate 106, according to various embodiments of the present disclosure. As illustrated, a lip 316 extends around the circumference of the first plate 106, with a first surface of the lip 316 (e.g., the bottom surface) lying on the same plane as the first surface of the first plate 316 (e.g., the bottom surface of the first plate 106), and a second surface of the lip 316 (e.g., the top surface of the lip 316) lying on a separate plane relative to a second surface of the remainder of the first plate 106 (e.g., the top surface of the first plate 106), causing the lip 316 to be thinner than the remainder of the first plate 106.

Figure 3D:
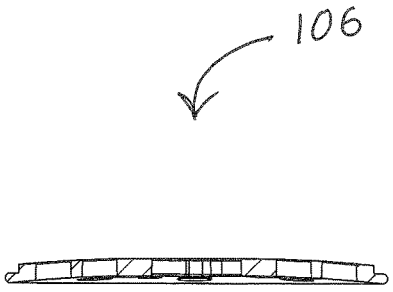

FIG. 3D presents a cross-sectional view of the first plate 106, according to various embodiments of the present disclosure. The lip 316 is illustrated. As shown, the bottom of the lip 316 lies on the same plane as the bottom of the first plate 106, while the top of the lip 316 lies on a lower plane than the top of the remaining portion of the first plate 106, resulting in a lip 316 that is thinner than the remaining portion of the first plate 106.

Figure 4A:
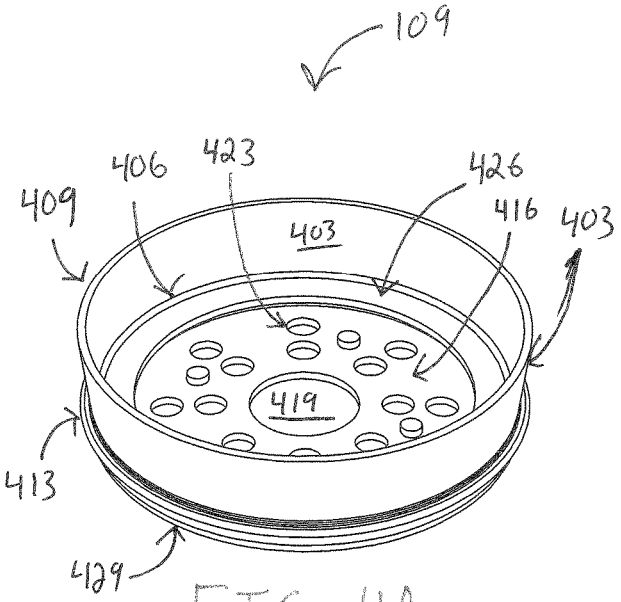
FIGS. 4A-4D depict a gasket used in the embodiment illustrated in FIG. 1, according to various embodiments of the present disclosure.
Figure 4B:
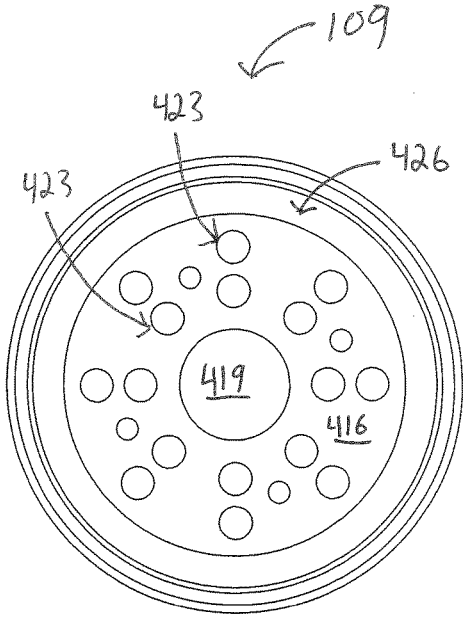
Figure 4C:
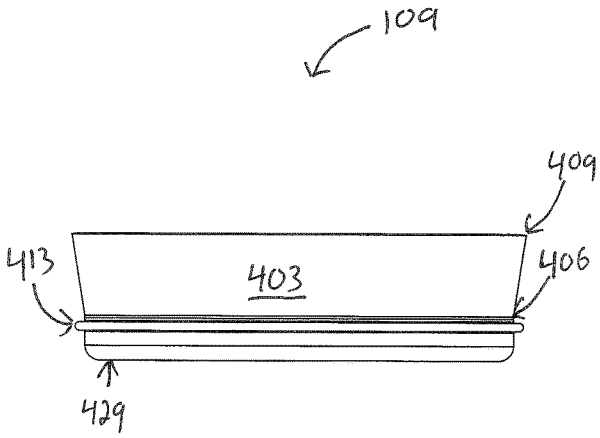
Figure 4D:
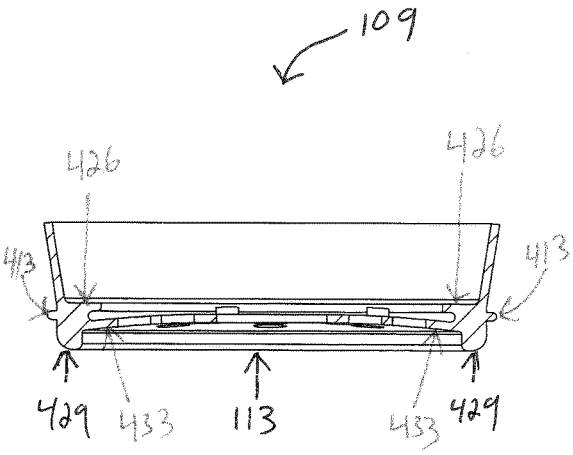

FIGS. 4A-4D depict a gasket 109 according to various embodiments of the present disclosure. FIG. 4A represents a perspective view of the gasket 109 according to various embodiments of the present disclosure. As shown, the gasket 109 includes a skirt 403 that expands from an inner diameter 406 to an outer diameter 409. The skirt 403 can be manufactured from various flexible materials (e.g., rubber, silicone, rubber or silicone based materials, etc.) in order to flex to fit the dimensions of a drain and thereby form at least a partial seal with a drain or drain wall. The gasket 109 also include a first rim 413 extending along an external, lateral surface (e.g., the outside wall of the gasket 109). In some instances, the first rim 413 may circle the gasket 109 at or below where the inner diameter 406 of the skirt 403 joins the remainder of the gasket 109. The gasket 109 can also include a grate 416. The grate 416 may include a hole 419 that is centered on the central point of the grate 416, which is also the central point of the gasket 109. Additional holes 423 may pierce the grate 416. Moreover, a lip 426 may extend from an internal surface of the gasket 109. The lip 426 can lay on a separate plane relative to the grate 416, forming a gap between the lip 426 and the grate 416 of sufficient size for the lip 316 of the first plate 106 to be inserted between the lip 426 of the gasket 109 and the grate 416 of the gasket 109. A second rim 429 forms a base for the gasket 109. FIG. 4B illustrates a top-down view of the gasket 109 according to various embodiments of the present disclosure. The relative positions of various parts of the gasket 109 according to various embodiments of the present disclosure, such as the grate 416, hole 419, additional holes 423, and the lip 426 are illustrated. FIG. 4C illustrates a side view of the gasket 109 according to various embodiments of the present disclosure. The relative positions of the skirt 403, the inner diameter 406 of the skirt 403, the outer diameter 409 of the skirt, the first rim 413, and the second rim 429 are depicted for an example embodiment of the present disclosure. FIG. 4D illustrates a cross-section of the gasket 109 according to various embodiments of the present disclosure. As shown, the second rim 429 leaves a cavity within which the second plate 113 can be placed, according to various embodiments of the present disclosure. Also shown are the lip 426 and a lower lip 433, between which the grate 416 can be inserted or otherwise disposed in order to secure the grate 416 to the gasket 109. Also illustrated are the first rim 413 and the second rim 1129

Figure 5A:
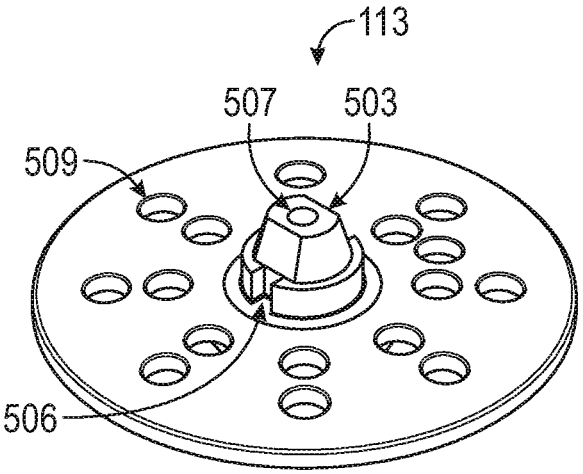
FIGS. 5A-5D depict a second plate used in the embodiment illustrated in FIG. 1, according to various embodiments of the present disclosure.
Figure 5B:
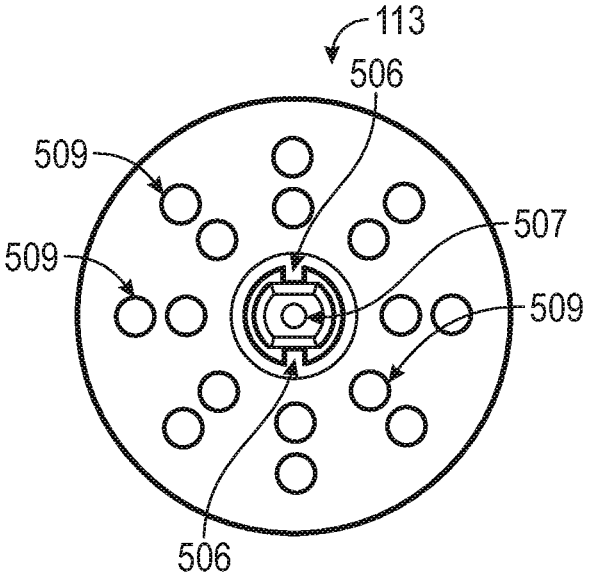
Figure 5C:
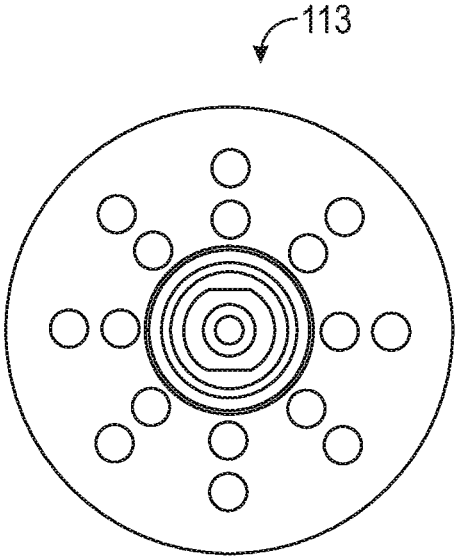
Figure 5D:
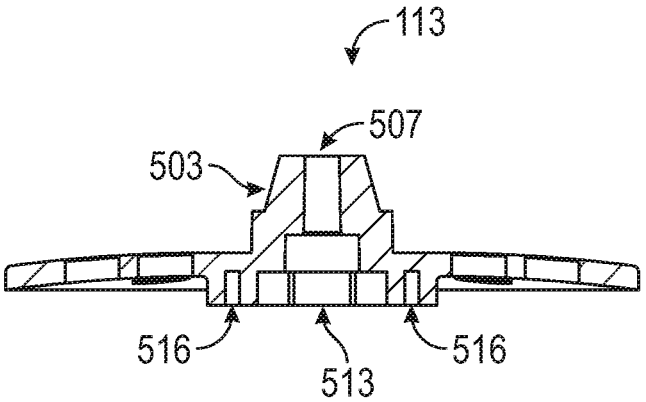

FIGS. 5A-5D depict a second plate 113 according to various embodiments of the present disclosure. FIG. 5A represents a perspective view of the second plate 113 according to various embodiments of the present disclosure. As shown in FIG. 5A, a protrusion 503 extends from the center of the second plate 113. The protrusion 503 is shaped to extend through the hole 419 of the gasket 109 and first hole 303 of the first plate 106 in order to fit within the primary internal cavity 213 of the handle 103. In some embodiments, one or more notches 506 may be placed along the base of the protrusion 503. The notches 506 may be shaped in order to allow the prongs 209 of the handle 103 to rest within the notches 506. When the prongs 209 of the handle 103 are placed within the notches 506 of the second plate 113, a rotation of the handle 103 will cause the second plate 113 to rotate in a corresponding manner. The protrusion 503 can also include an opening 507 to permit a fastener 116 to pass through the second plate 113. Accordingly, the opening 507 may be aligned with the secondary cavity 213 of the handle 103 in order to allow the fastener 116 to fit within the secondary cavity 213 of the handle 103 to fasten the handle 103 to the second plate 113. The second plate 113 can also include one or more holes 509 spaced at various intervals. FIG. 5B illustrates a top-down view of the second plate 113 according to various embodiments of the present disclosure. The notches 506 in the base of the protrusion 503 and the opening 507 at the top of the protrusion 503 can be seen as well as the various holes 509 through the second plate 113. FIG. 5C illustrates a bottom view of the second plate 113 according to various embodiments of the present disclosure that is similar to the illustrations provided by the top view of FIG. 5B. FIG. 5D illustrates a cross-section of the second plate 113 according to various embodiments of the present disclosure. At the top of the protrusion 503 is the opening 507. Underneath is a second opening 513 through which a fastener 116 can be inserted. Two cross-sections of a secondary cavity 516 within which portions of the container 123 may fit are also illustrated.

Figure 6A:
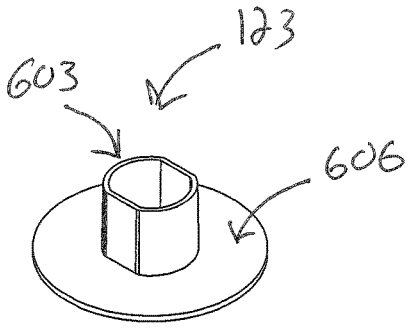
FIGS. 6A-6D used in the embodiment illustrated in FIG. 1, depict a container according to various embodiments of the present disclosure.
Figure 6B:
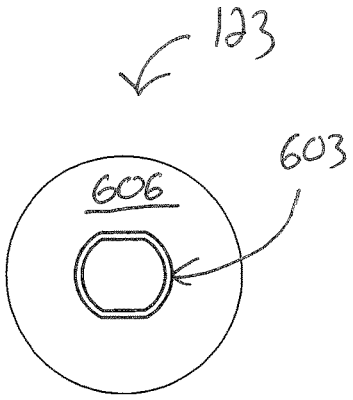
Figure 6C:
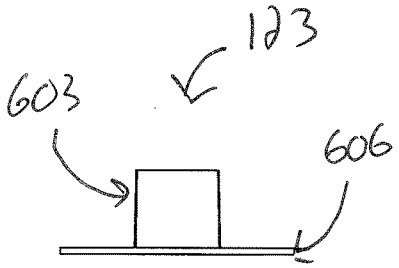
Figure 6D:
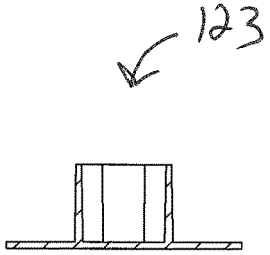

FIGS. 6A-6D depict a container 123 according to various embodiments of the present disclosure. FIG. 6A represents a perspective view of the container 123 according to various embodiments of the present disclosure. The illustrated container 123 includes a hollow shaft 603 extending from the rim 606 of the container 123. The hollow shaft 603 can be shaped to fit within the secondary cavity 516 of the second plate 113. In these embodiments, the container 123 may be held in place by friction between the surface of the secondary cavity 516 of the second plate 113 and the surface of the shaft 603. The rim 606 extends a sufficient distance 606 from the base of the shaft 603 to secure a biocide 119. FIG. 6B illustrates a top-down view of the container 123 according to various embodiments of the present disclosure. The hollow shaft 603 and the rim 606 are both depicted. FIG. 6C illustrates a side view of the container 123 according to various embodiments of the present disclosure. The hollow shaft 603 and the rim 606 are both depicted. FIG. 6D illustrates a cross-section of the container 123 according to various embodiments of the present disclosure. It should be noted, however, that other containers 123 (e.g., baskets) may be used in various embodiments of the present disclosure.

Figure 7A:
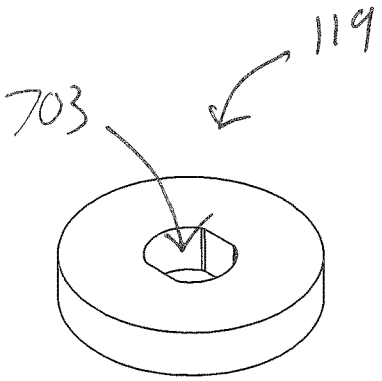
FIGS. 7A-7D depict a biocide or biological agent used in the embodiment illustrated in FIG. 1, according to various embodiments of the present disclosure.
Figure 7B:
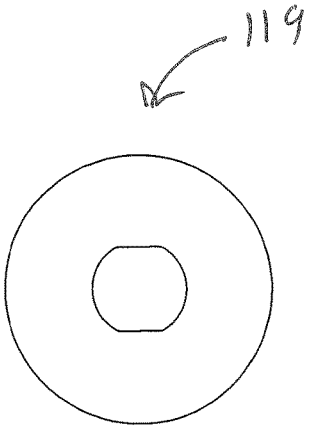
Figure 7C:
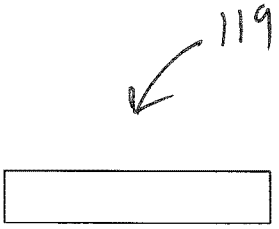
Figure 7D:
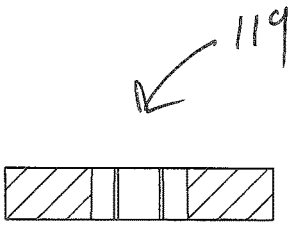

FIGS. 7A-7D depict a biocide 119 (e.g., an anti-microbial, anti-fungal, enzymatic agent or other similar agent) according to various embodiments of the present disclosure. The biocide 119 may be in the form of a tablet, crystal, or other structure. For example, the biocide could include an antibiotic agent or anti-fungal agent that kills bacteria, mold, or mildew growing inside a drain or pipe. Likewise, the biocide 119 can include an enzymatic agent that degrade or break down bio-films that build up inside pipes, thereby allowing the biofilm to be washed through the drain or pipe. FIG. 7A represents a perspective view of the biocide 119 according to various embodiments of the present disclosure. As shown, the biocide 119 is shaped to fit the container 123. Here, the exemplary biocide is circularly shaped in the same manner as the container 123 with a centrally located hole 703 through which the shaft 603 of the container may pass through in order to secure the biocide 119 to the underside of the second plate 113. FIG. 7B illustrates a top-down view of the biocide 119 according to various embodiments of the present disclosure. FIG. 7C illustrates a side view of the biocide 119 according to various embodiments of the present disclosure. FIG. 7D illustrates a cross-section of the biocide 119 according to various embodiments of the present disclosure.

Figure 8:
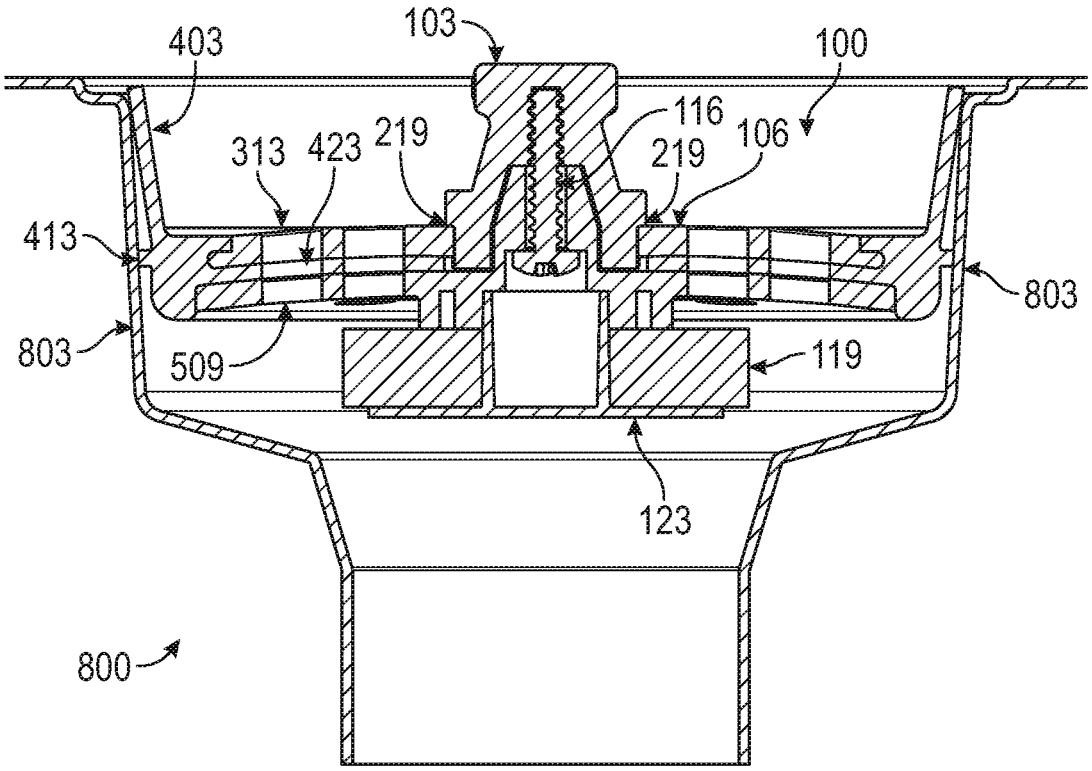
FIG. 8 depicts a cross-sectional view of an implementation of the embodiment illustrated in FIG. 1, according to various embodiments of the present disclosure.

FIG. 8 is a cross-sectional view of an embodiment of the present disclosure that illustrate the principals underlying the operation of the various embodiments of the present disclosure. As depicted, the handle 103, the first plate 106, the gasket 109, the second plate 113, the fastener 116, the biocide 119, and the container 123 are assembled to form an embodiment of the sink stopper and strainer 100, which has been placed within a drain 800. The skirt 403 and the first rim 413 are in contact with the walls 803 of the drain, forming at least a partial seal with the walls of the drain 800. This seal prevents liquids from flowing around the sink stopper and strainer 100 and down the walls 803 of the drain 800. The second hole(s) 313 of the first plate 106, the additional holes 423 of the gasket 109, and the holes 509 of the second plate 113 are aligned to allow liquid to pass through the assembled drain stopper. The handle 103 can be turned, causing the second plate 113 to rotate and moving the holes 509 of the second plate 113 out of alignment with the second hole(s) 313 of the first plate 313 and the holes 423 of the gasket, thereby closing the sink stopper and strainer 100 and preventing the flow of liquids through it. As illustrated, the fastener 116 joins the second plate 113 to the handle 103. The first plate 106 and the gasket 109 are secured within the space created between the second plate 113 and the ledge 219 of the handle 103. A container 123 is affixed to the second plate 113, thereby securing a biocide 119 to the underside of the second plate 113. As liquid (e.g., water) flows through the second hole(s) 313 of the first plate 106, the additional holes 423 of the gasket 109, and the holes 509 of the second plate 113, the liquid may slowly dissolve the biocide 119, thereby depositing a portion of the biocide 119 within the drain 800 to clean or disinfect the drain 800.

Figure 9:
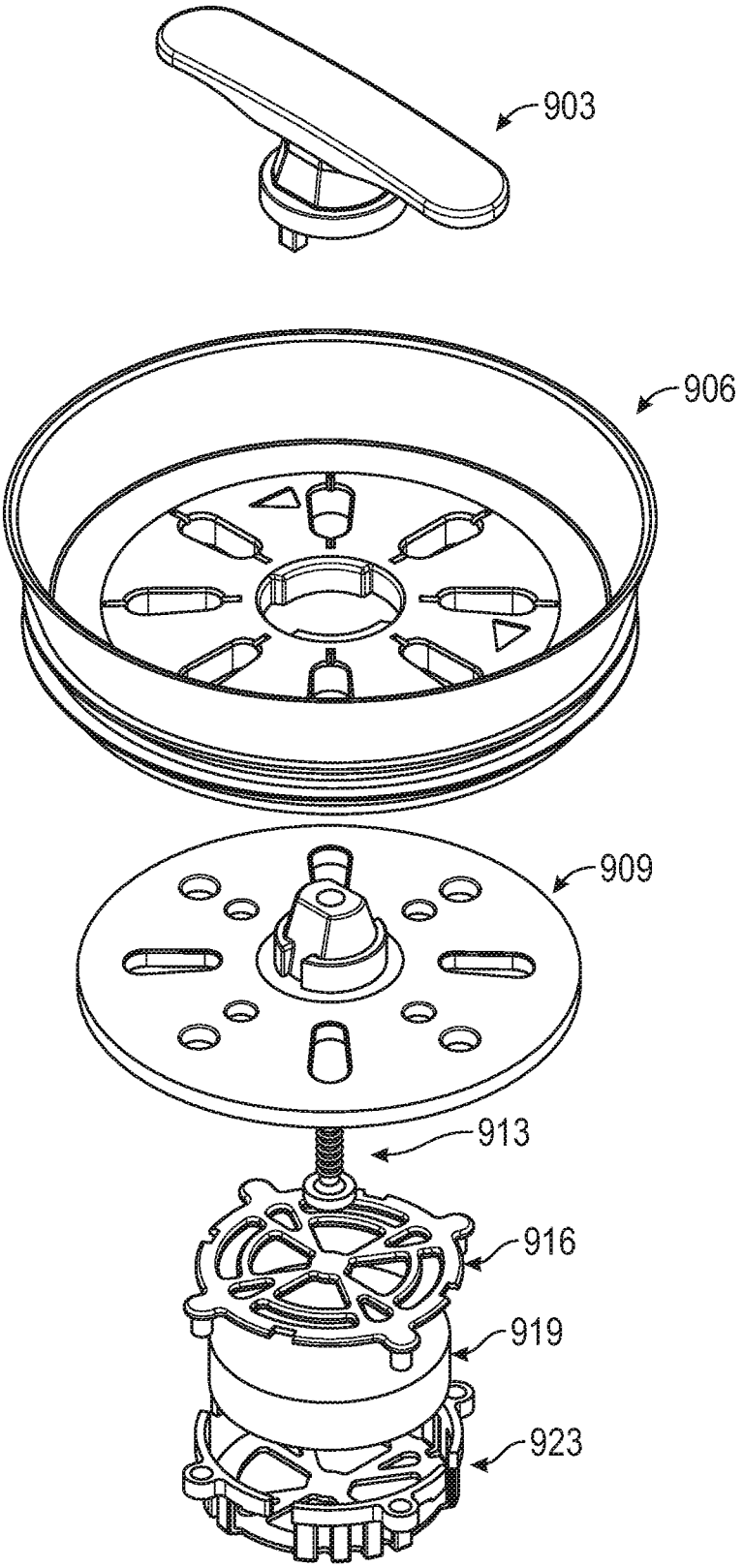
FIG. 9 is an exploded view of another example embodiment of the present disclosure.

FIG. 9 illustrates an exploded view of an alternative embodiment of a sink stopper and strainer 900, according to various embodiments of the present disclosure. A handle 903, a gasket 906, a plate 909, a fastener 913, a first portion 916 of a container, a biocide 919, and a second portion 923 of the container. Although specific implementations of the handle 903, the plate 906, the gasket 909, the fastener 913, the first portion 916 of the container, the biocide 919, and the second portion 923 of the container are depicted in FIG. 9, alternative implementations may be used in various embodiments of the present disclosure.

Figure 10B:
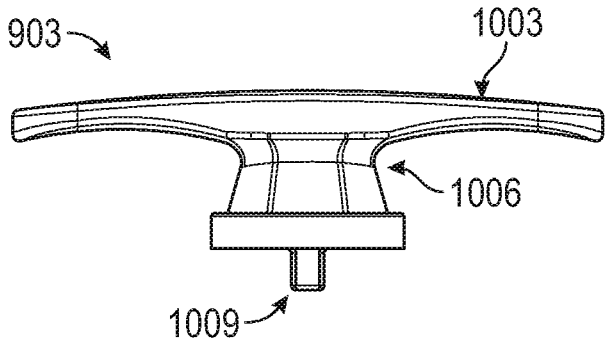
FIGS. 10A-10D depict a handle used in the embodiment illustrated in FIG. 9, according to various embodiments of the present disclosure.
Figure 10A:
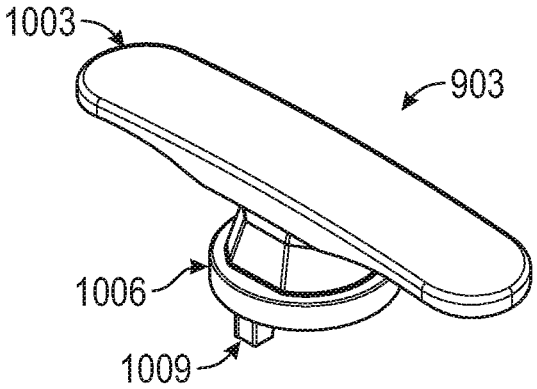

FIGS. 10A-10D depict a handle 903 according to various embodiments of the present disclosure. In FIG. 10A, a perspective view of the handle 903 is depicted. The handle 903 includes a grip 1003, a base 1006, and at least one prong 1009 extending from the base 1006. In some embodiments, the sides of the base 1006 may taper as the sides extend from the junction of the base with the prong 1009 to the junction of the base 1006 with the grip 1003. FIG. 10B depicts a side view of the handle 903 with the grip 1003, base 1006, and at least one prong 1009 extending from the base 206.

Figure 10C:
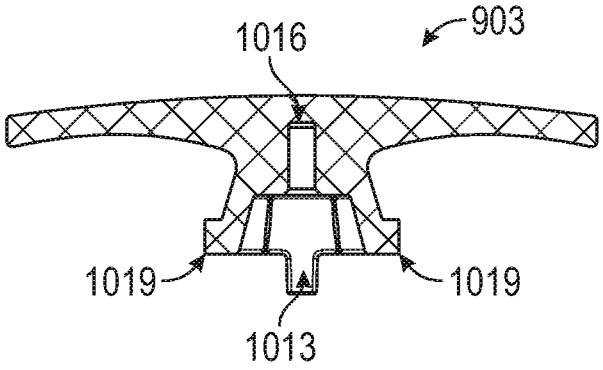

FIG. 10C depicts a cross section of the handle 903. As shown, within the base 1006 is a primary internal cavity 1013. Above the primary internal cavity 1013 is a secondary cavity 1016, which may be configured to receive a fastener 913 (FIG. 9), as further described herein. For example, the secondary cavity 1016 may be threaded in order to receive a screw. In some embodiments, the external surface of prongs 1009 may be offset relative to the external surface of the base 1006, resulting in a ledge 1019 to overhand the prongs 1009.

Figure 10D:
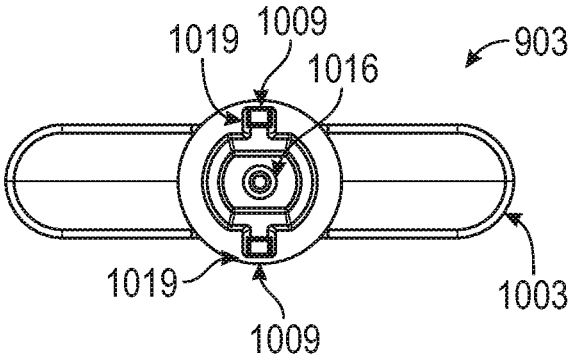

FIG. 10D depicts a bottom-up view of the handle 903 according to various embodiments of the present disclosure. Illustrated are the handle 1003, the secondary cavity 1016 within the primary internal cavity 1013 (FIG. 2C), and the ledge 1019 formed by the base 1006 (FIG. 10B) that overhangs the prongs 1009.

Figure 11B:
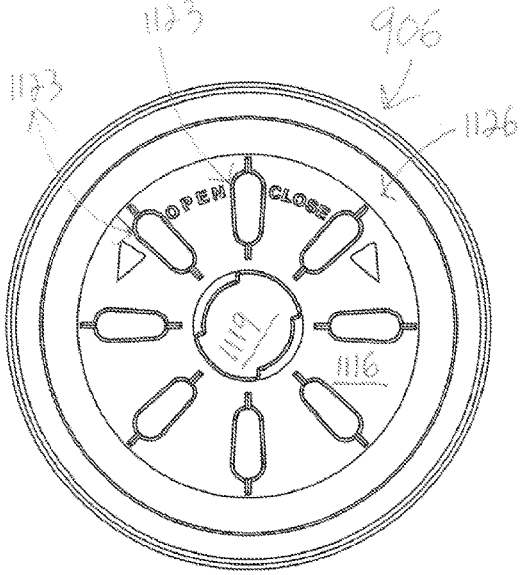
FIGS. 11A-11D depict a gasket, according to various embodiments of the present disclosure.
Figure 11A:
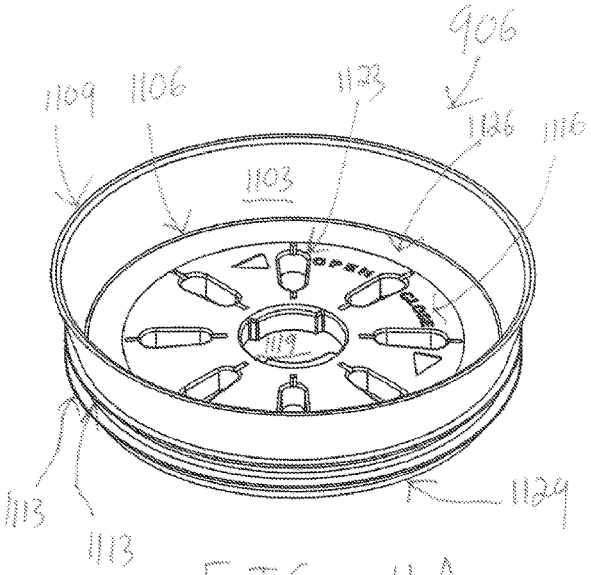
Figure 11D:
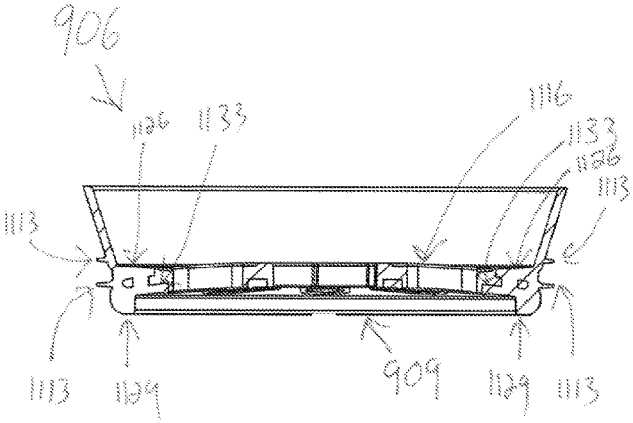
Figure 11C:
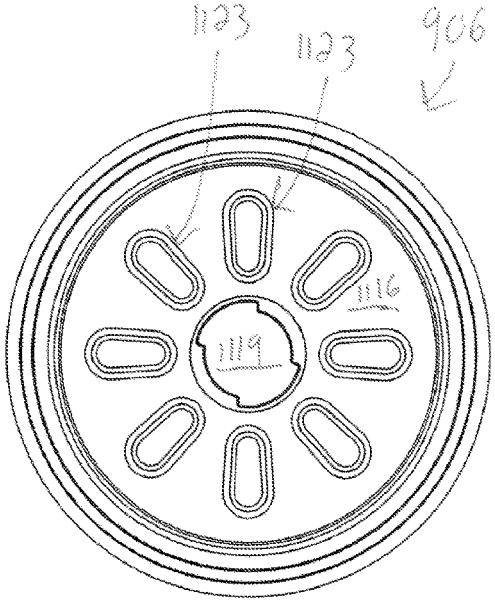

FIGS. 11A-11D depict a gasket 906 according to various embodiments of the present disclosure. FIG. 11A represents a perspective view of the gasket 906 according to various embodiments of the present disclosure. As shown, the gasket 906 includes a skirt 1103 that expands from an inner diameter 1106 to an outer diameter 1109. The skirt 1103 can be manufactured from various flexible materials (e.g., rubber, silicone, rubber or silicone based materials, etc.) in order to flex to fit the dimensions of a drain and thereby form at least a partial seal with a drain or drain wall. The gasket 906 also include one or more lateral rims 1113 extending along an external, lateral surface (e.g., the outside wall of the gasket 109). In some instances, the lateral rims 1113 may circle the gasket 906 at or below where the inner diameter 1106 of the skirt 1103 joins the remainder of the gasket 906. The gasket 906 can also include a grate 1116. The grate 1116 may include a hole 1119 that is centered on the central point of the grate 1116, which is also the central point of the gasket 906. Additional holes 1123 may pierce the grate 1116. Moreover, a lip 1126 may extend from an internal surface of the gasket 906. The lip 1126 can lay on a separate plane relative to the grate 1116, allowing for the grate 1116 to be inserted under the lip 1126 to secure or fasten the grate 1116 to the gasket 109. A base rim 1129 forms a base for the gasket 906. FIG. 11B illustrates a top-down view of the gasket 906 according to various embodiments of the present disclosure. The relative positions of various parts of the gasket 906 according to various embodiments of the present disclosure, such as the grate 1116, hole 1119, additional holes 1123, and the lip 1126 are illustrated. FIG. 11C illustrates a bottom-up view of the gasket 906 according to various embodiments of the present disclosure. The relative positions of various parts of the gasket 906 according to various embodiments of the present disclosure, such as the grate 1116, hole 1119, and additional holes 1123, are illustrated.

FIG. 11D illustrates a cross-section of the gasket 906 according to various embodiments of the present disclosure. As shown, the base rim 1129 leaves a cavity within which the plate 909 can be placed, according to various embodiments of the present disclosure. Also shown are the lip 1126 and a lower lip 1133, between which the grate 1116 can be inserted or otherwise disposed in order to secure the grate 1116 to the gasket 906. Also illustrated are the lateral rims 1113 and the base rim 1129

Figure 11F:
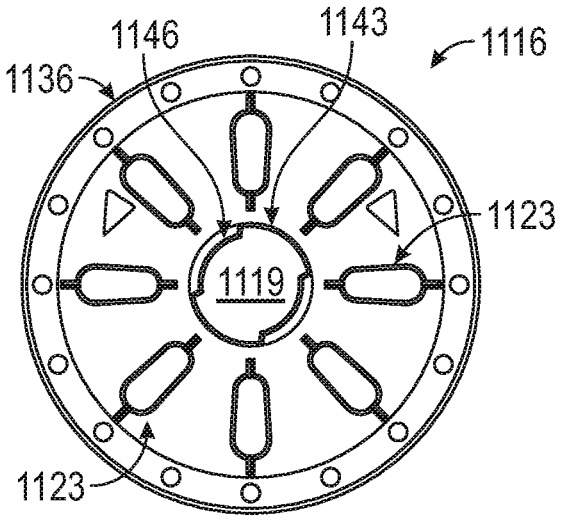
FIGS. 11E-11H depict a component of the gasket, according to various embodiments of the present disclosure.
Figure 11E:
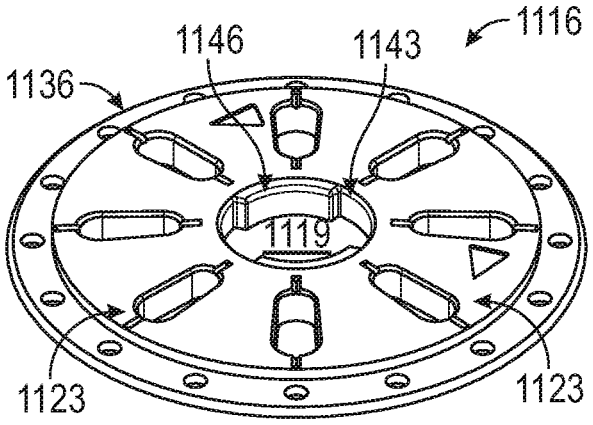

FIGS. 11E-11H depict the grate 1116 used in the gasket 906, according to various embodiments of the present disclosure. In FIG. 11E, a perspective view of the grate 1116 is depicted. The grate 1116 includes a lip 1136 along the circumference of the grate 1116. A first surface of the lip 1136 may lie on the same plane as a first surface of the grate 1116, while a second surface of the lip 1136 may lie on a separate plane relative to a second surface of the grate 1116, causing the lip 1136 to be thinner than the remaining portion of the grate 1116. For example, the bottom of the lip 1136 may lie on the same plane as the bottom of the grate 1116, while the top of the lip 1136 may lie on a lower plane than the top of the remaining portion of the grate 1116, resulting in a lip 1136 that is thinner than the remaining portion of the grate 1116. The grate 1116 can also include a hole 1119 centered within the grate 1116. The hole 1119 includes an outer edge 1143 and an inner edge 1146. The grate 1116 can also include one or more holes 1123 positioned between the rim of the grate 1116 and the hole 1119.

FIG. 11F provides a top-down perspective of the grate 1116, showing the relative positions of the hole 1119, the inner edge 1146 of the hole 1119, the outer edge 1143 of the hole 1119, multiple additional holes 1123, and the lip 1136, according to various embodiments of the present disclosure.

Figure 11H:
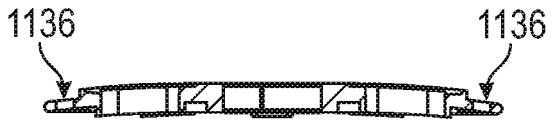
Figure 11G:
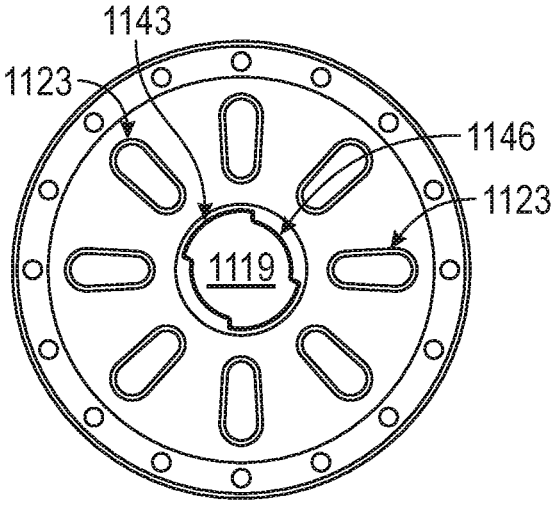

FIG. 11G provides a bottom-up perspective of the grate 1116 corresponding to the top-down view provided in FIG. 11F. The relative positions of the hole 1119, the inner edge 1146 of the hole 1119, and the outer edge 1143 of the hole 1119, as well as multiple additional holes 1123, are provided.

FIG. 11H presents a cross-sectional view of the first grate 1116, according to various embodiments of the present disclosure. The lip 1136 is illustrated. As shown, the bottom of the lip 1136 lies on the same plane as the bottom of the grate 1116, while the top of the lip 1136 lies on a lower plane than the top of the remaining portion of the grate 1116, resulting in a lip 1136 that is thinner than the remaining portion of the grate 1116.

Figure 12B:
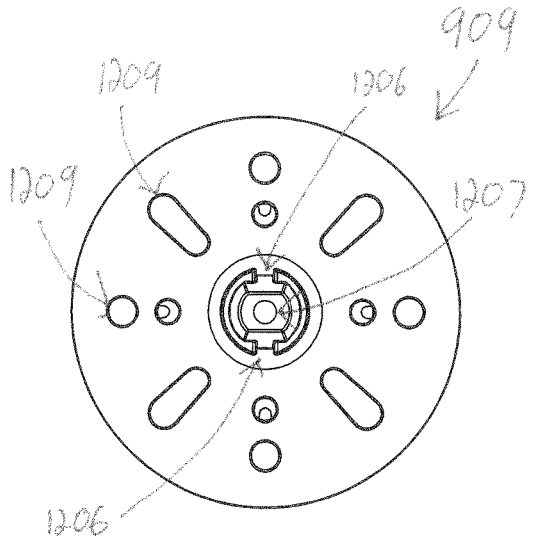
FIGS. 12A-12D depict a plate, according to various embodiments of the present disclosure.
Figure 12A:
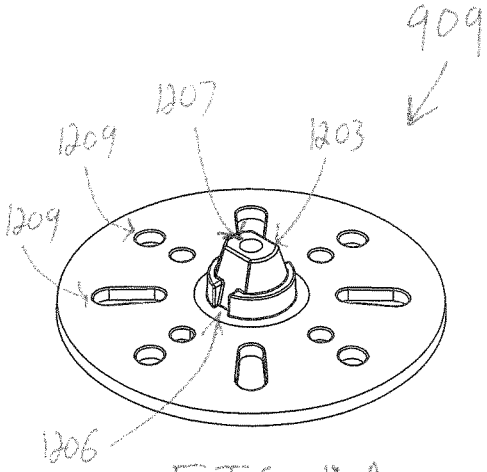

FIGS. 12A-12D depict a plate 909 according to various embodiments of the present disclosure. FIG. 12A represents a perspective view of the plate 909 according to various embodiments of the present disclosure. As shown in FIG. 12A, a protrusion 1203 extends from the center of the plate 909. The protrusion 1203 is shaped to extend through the hole 1123 of the gasket 906 in order to fit within the primary internal cavity 1013 of the handle 903. In some embodiments, one or more notches 1006 may be placed along the base of the protrusion 1203. The notches 1206 may be shaped in order to allow the prongs 1009 of the handle 903 to rest within the notches 1206. When the prongs 1009 of the handle 903 are placed within the notches 1206 of the plate 909, a rotation of the handle 903 will cause the plate 909 to rotate in a corresponding manner. The protrusion 1203 can also include an opening 1207 to permit a fastener 913 to pass through the plate 909. Accordingly, the opening 1207 may be aligned with the secondary cavity 1013 of the handle 903 in order to allow the fastener 913 to fit within the secondary cavity 1013 of the handle 903 to fasten the handle 903 to the plate 909. The plate 909 can also include one or more holes 1209 spaced at various intervals. FIG. 12B illustrates a top-down view of the plate 909 according to various embodiments of the present disclosure. The notches 1206 in the base of the protrusion 1203 and the opening 1207 at the top of the protrusion 1203 can be seen as well as the various holes 1209 through the plate 909.

Figure 12D:
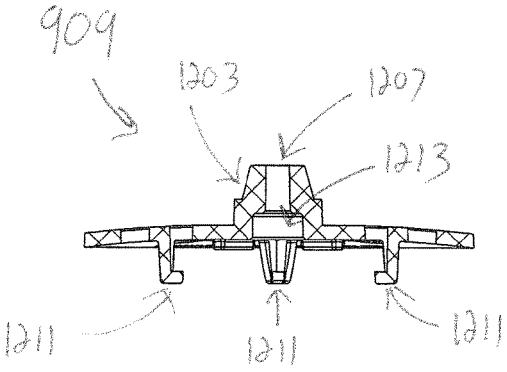
Figure 12C:
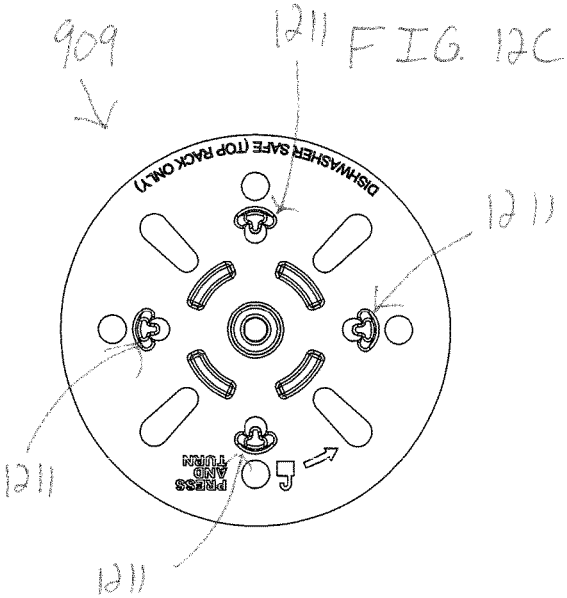

FIG. 12C illustrates a bottom view of the plate 909 according to various embodiments of the present disclosure that is similar to the illustrations provided by the top view of FIG. 5B. Placed on the bottom of the plate 909 are one or more fasteners 1211. The fasteners 1211 serve to secure the first portion 916 of the container for the biocide 919. The fasteners 1211 can include, for example, clips, clasps, snaps, or other types of fasteners.

FIG. 12D illustrates a cross-section of the plate 909 according to various embodiments of the present disclosure. At the top of the protrusion 1203 is the opening 1207. Underneath is a second opening 1213 through which a fastener 913 can be inserted. Several fasteners 1211 are located on the bottom surface of the plate 909 in order to secure the first portion 916 of the container for the biocide 919 to the plate 909.

Figure 13B:
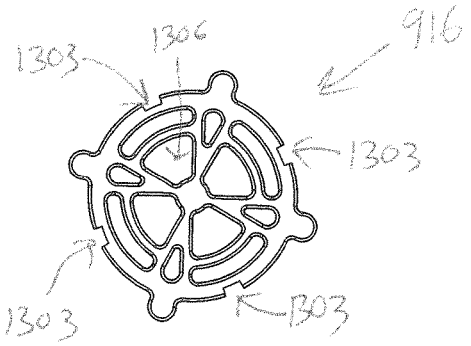
FIGS. 13A-13D depict a first portion of a container, according to various embodiments of the present disclosure.
Figure 13A:
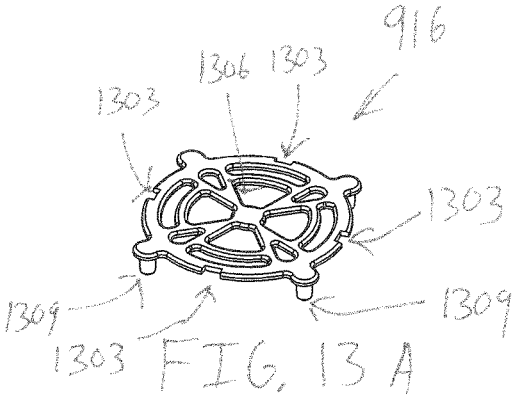
Figure 13D:
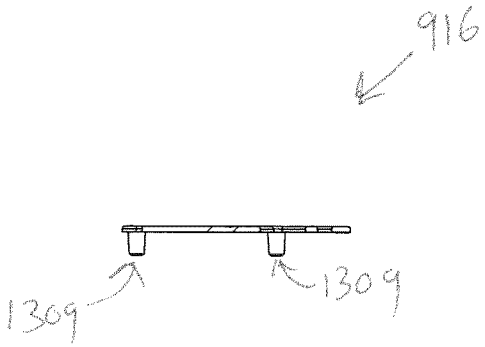
Figure 13C:
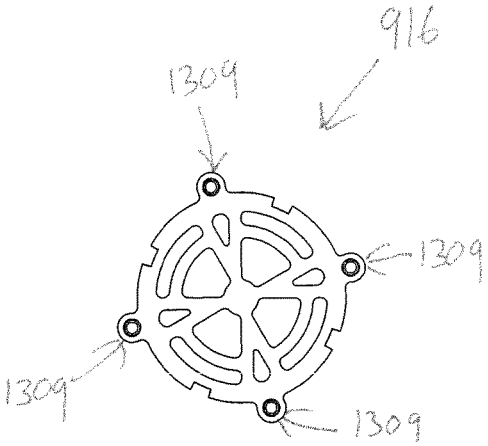

FIGS. 13A-13D depict a first portion 916 of a container for the biocide 919 according to various embodiments of the present disclosure. FIG. 13A provides a perspective view of the first portion 916 of a container for the biocide 919. The first portion 916 of a container for the biocide 919 includes one or more notches 1303 allowing the fasteners 1211 of the plate 909 to secure or engage the first portion 916 of a container for the biocide 919. The first portion 916 of a container for the biocide 919 also includes a perforated surface 1306, which allows for liquids to pass over the biocide 919. One or more fasteners 1309 also extend from the first portion 916 of a container for the biocide 919. The fasteners 1309 can include posts, prongs, clips, or other types of fasteners. FIG. 13B is a top-down view of the first portion 916 of a container for the biocide 919, illustrating the positions of the notches 1303 and the perforated surface 1306. FIG. 13C is a bottom-up view of the first portion 916 of a container for the biocide 919, illustrating the positions of the notches 1303, the perforated surface 1306, and the fasteners 1309. FIG. 13D is a side-view of the first portion 916 of a container for the biocide 919, illustrating the fasteners 1309 extending from the first portion 916 of a container for the biocide 919.

Figure 14B:
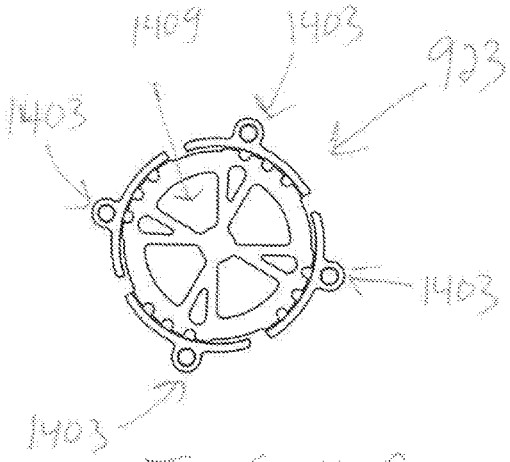
FIGS. 14A-14D depict a second portion of a container, according to various embodiments of the present disclosure.
Figure 14A:
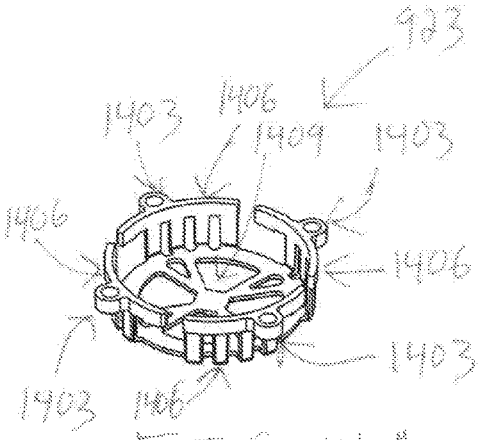
Figure 14D:
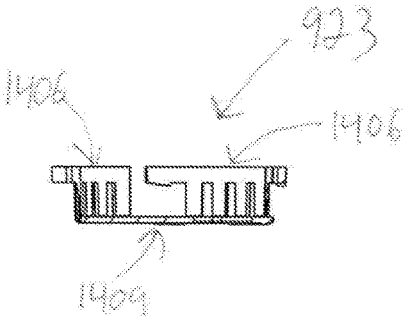
Figure 14C:
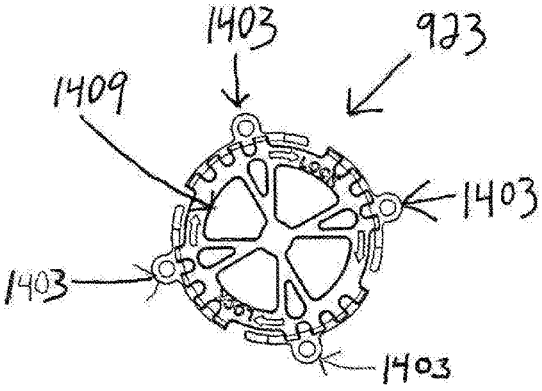
Figure 15B:
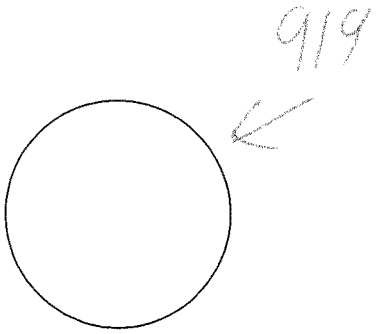
FIGS. 15A-15D depict a biocide or biological agent, according to various embodiments of the present disclosure.
Figure 15A:
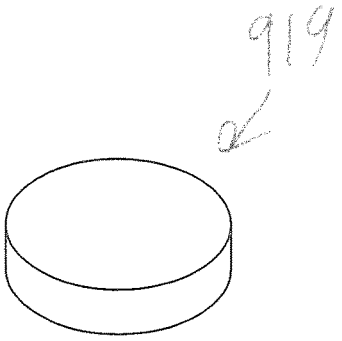
Figure 15D:
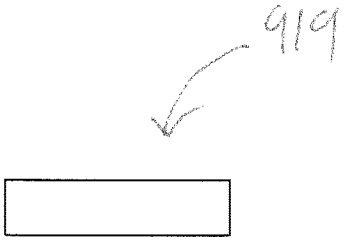
Figure 15C:
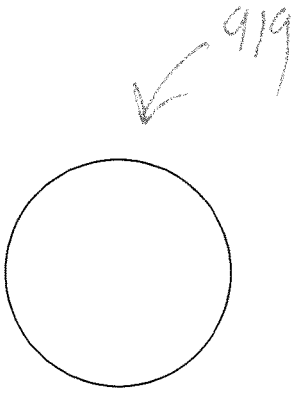

FIGS. 14A-14D depict a second portion 923 of a container for the biocide 919 according to various embodiments of the present disclosure. FIG. 14A provides a perspective view of the second portion 923 of a container for the biocide 919. The second portion 923 of a container for the biocide 919 includes one or more receivers 1403 configure to fit the fasteners 1309 of the first portion 919 of the container for the biocide 919. Examples of the receivers 1403 include post holes, snaps, or other receiving members of a fastener. The second portion 923 of the container for the biocide 919 also includes one or more perforated walls 1406. The perforated walls 1406 contain the biocide 919 within the container formed by the first portion 916 and the second portion 923 of the container for the biocide 919. The perforations allow for liquid to enter the container and pass over the biocide 919. The second portion 923 of the container for the biocide 919 also includes a perforated base 1409, which allows liquids that have entered the container to exit the container formed by the first portion 916 and the second portion 919. FIG. 14B is a top-down view of the second portion 923 of the container for the biocide 919, illustrating the positions of the receivers 1403 and the perorated base 1409. FIG. 14C is a bottom-up view of the second portion 923 of a container for the biocide 919, illustrating the positions of the receivers 1403 and the perforated base 1409. FIG. 14D is a side-view of the second portion 923 of a container for the biocide 919, illustrating the perforated walls 1406 and the perforated surface 1409.

FIGS. 15A-15D provide various perspectives of a tablet or crystal biocide 919, according to various embodiments of the present disclosure.

Figure 16B:
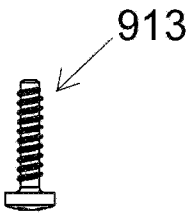
FIGS. 16A-16C depict a fastener, according to various embodiments of the present disclosure.
Figure 16A:
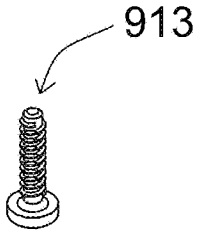
Figure 16C:
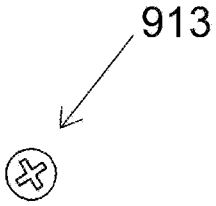

FIGS. 16A-16C provide various perspectives of a fastener 913, according to various embodiments of the present disclosure. Although a threaded screw is illustrated as an example implementation of the fastener 913, other types of fasteners 913 may be used in various embodiments of the present disclosure.

Figure 17:
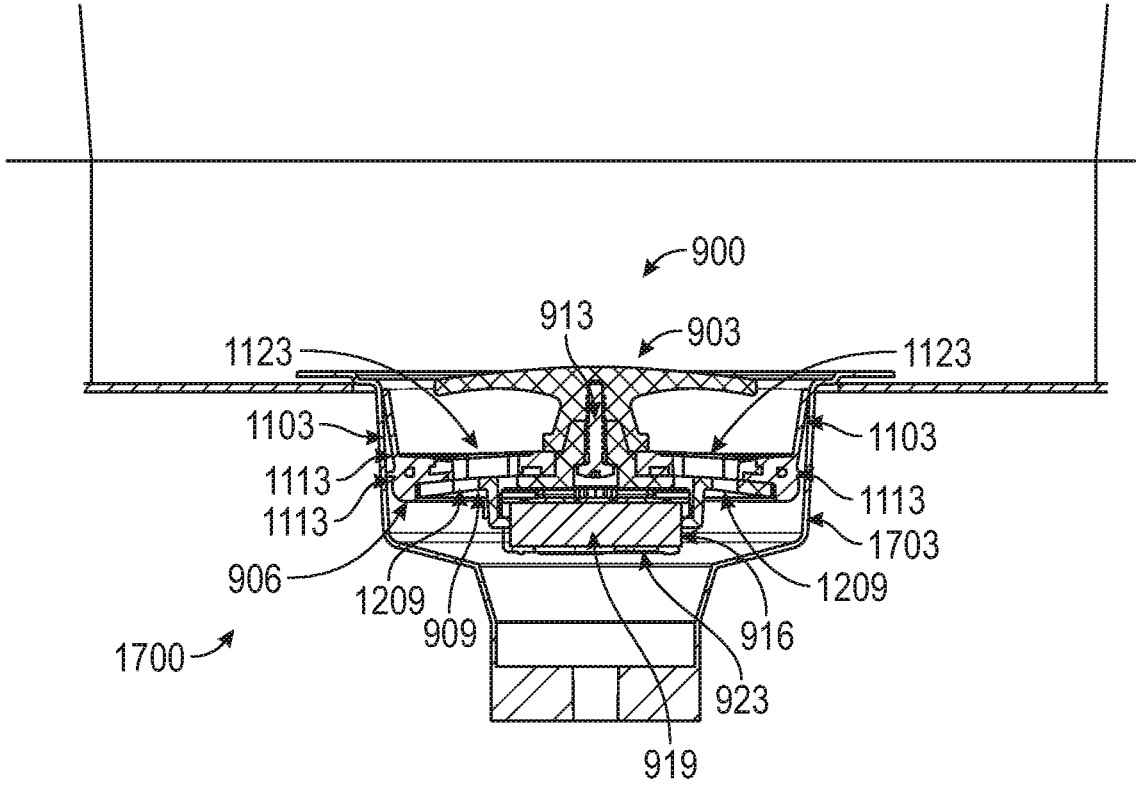
FIG. 17 depicts a cross-sectional view of an implementation of an embodiment of the present disclosure.

FIG. 17 is a cross-sectional view of an embodiment of the present disclosure that illustrate the principals underlying the operation of the various embodiments of the present disclosure. As depicted, the handle 903, the gasket 906, the plate 909, the fastener 913, and the first portion 916 and second portion 923 of the container for the biocide 919 are assembled to form an embodiment of the present disclosure, which has been placed within a drain 1700. The skirt 1103 and one or more rims 1113 are in contact with the walls 1703 of the drain 1700, forming at least a partial seal with the walls of the drain 1700. This seal prevents liquids from flowing around the drain stopper and down the walls 1703 of the drain 1703. The holes 1123 of the grate 1116 of the gasket 906 can aligned with the holes 1209 of the plate 909 to allow liquids to pass through the assembled sink stopper and strainer 900. The handle 903 can be turned, causing the plate 909 to rotate and moving the holes 1209 of the plate 909 out of alignment with the holes 1123 of the grate 1116 of the gasket 906, thereby closing the sink stopper and strainer 900 and preventing the flow of liquids through it. As illustrated, the fastener 913 joins the plate 909 to the handle 903. The gasket 906 is secured within the space created between the plate 909 and the ledge 1019 of the handle 903. The first portion 916 of the container for the biocide 919 is affixed to the plate 909 and the second portion 923 of the container for the biocide 919 is affixed to the first portion 916, thereby securing a biocide 119 to the underside of the plate 909. As liquid (e.g., water) flows through the sink stopper and strainer 900, the liquid may slowly dissolve the biocide 919, thereby depositing a portion of the biocide 919 within the drain 1700 to clean or disinfect the drain 1700.

Disjunctive language such as the phrase "at least one of X, Y, or Z," unless specifically stated otherwise, is otherwise understood with the context as used in general to present that an item, term, etc., may be either X, Y, or Z, or any combination thereof (e.g., X, Y, or Z). Thus, such disjunctive language is not generally intended to, and should not, imply that certain embodiments require at least one of X, at least one of Y, or at least one of Z to each be present.

It should be emphasized that the above-described embodiments of the present disclosure are merely possible examples of implementations set forth for a clear understanding of the principles of the disclosure. Many variations and modifications may be made to the above-described embodiments without departing substantially from the spirit and principles of the disclosure. All such modifications and variations are intended to be included herein within the scope of this disclosure and protected by the following claims.

Therefore, the following is claimed:

1. A sink stopper, comprising:

a gasket comprising a first plurality of holes;

a plate comprising a protrusion and a second plurality of holes, wherein the protrusion is shaped to extend through a portion of the gasket;

a rotatable handle that, when rotated, adjusts an alignment of the first plurality of holes of the gasket with respect to the second plurality of holes of the plate, wherein the rotatable handle is configured to engage with the protrusion of the plate; and a container attached to a bottom surface of the plate.

2. The sink stopper of claim 1, wherein the container comprises a first portion that attaches to a second portion, wherein the first portion is attached to the plate.

3. The sink stopper of claim 2, wherein the bottom surface of the plate further comprises a fastener that extends away from the bottom surface of the plate, and the fastener attaches to a notch along a perimeter of the first portion of the container.

4. The sink stopper of claim 3, wherein the fastener of the plate is positioned between two of the second plurality of holes on the plate.

5. The sink stopper of claim 1, further comprising a biocide placed within the container.

6. The sink stopper of claim 1, wherein the gasket comprises an aperture surrounded by the first plurality of holes, and the aperture comprises an outside edge and an inside edge.

7. The sink stopper of claim 6, wherein a shape of the protrusion of the plate corresponds to the outside edge and the inside edge of the gasket.

8. The sink stopper of claim 1, wherein the rotatable handle further comprises a prong extending from a base of the rotatable handle.

9. The sink stopper of claim 8, wherein the plate further comprises a notch in the protrusion of the plate, wherein the notch is configured to receive the prong from the rotatable handle.

10. The sink stopper of claim 1, wherein a bottom surface of the gasket comprises a base rim that forms a cavity for receiving the plate.

11. An apparatus, comprising:

a gasket comprising a first plurality of holes;

a plate comprising a protrusion and a second plurality of holes, wherein the protrusion is shaped to extend through a portion of the gasket; and a rotatable handle that, when rotated, adjusts an alignment of the first plurality of holes of the gasket with respect to the second plurality of holes, wherein the rotatable handle comprises an inner cavity is configured to engage with the protrusion of the plate.

12. The apparatus of claim 11, further comprising: a container attached to a bottom surface of the plate, wherein the container comprises a first portion and a second portion.

13. The apparatus of claim 12, wherein the bottom surface of the plate further comprises a fastener that extends away from the bottom surface of the plate, and the fastener attaches to a notch along a perimeter of the first portion of the container.

14. The apparatus of claim 11, wherein the rotatable handle further comprises a prong extending from a base of the rotatable handle.

15. The apparatus of claim 14, wherein the protrusion further comprises a notch that is configured to receive the prong from the rotatable handle.

16. The apparatus of claim 15, wherein the gasket comprises an aperture, and the aperture comprises an outside edge and an inside edge.

17. The apparatus of claim 12, further comprising a biological agent placed within the container.

18. The apparatus of claim 11, wherein a bottom surface of the gasket comprises a base rim that forms a cavity for receiving the plate.

19. The apparatus of claim 11, wherein a shape of the protrusion of the plate corresponds to a perimeter formed by an outside edge and an inside edge of a center aperture of the gasket.

20. The apparatus of claim 11, wherein the gasket further comprises:

a flexible skirt expanding from an inner diameter to an outer diameter; and a first rim extending along an external, lateral surface of the gasket.

* * * * *